United States Patent [19]

Harmon et al.

[11] Patent Number: 4,852,923

[45] Date of Patent: Aug. 1, 1989

[54] VERTICAL ACCESS ADJUSTABLE LATCHING MECHANISM EXTERNALLY ACCESSIBLE ADJUSTABLE KEEPER MECHANISM

[75] Inventors: Raymond E. Harmon, Orange; William R. E. McCown, Montclair, both of Calif.

[73] Assignee: Rexnord Holdings Inc., Brookfield, Wis.

[21] Appl. No.: 19,913

[22] Filed: Feb. 27, 1987

[51] Int. Cl.[4] ..... E05B 15/02

[52] U.S. Cl. ..... 292/341.18; 292/DIG. 60

[58] Field of Search ..... 292/341.18, 341.19, 292/340, DIG. 60, 142; 74/89.15, 530, 425

[56] References Cited

U.S. PATENT DOCUMENTS

| | | | |
|---|---|---|---|
| Re. 31,935 | 7/1985 | Poe | 292/113 |
| 2,532,630 | 12/1950 | Licktieg | 292/142 |
| 2,650,848 | 9/1953 | Garbs | 292/341.18 |
| 2,876,031 | 3/1959 | Claud-Mantle | 292/112 |
| 2,913,273 | 11/1959 | Claud-Mantle | 292/246 |
| 2,916,901 | 12/1959 | Claud-Mantle | 70/76 |
| 2,939,734 | 6/1960 | Claud-Mantle | 292/64 |
| 3,036,476 | 5/1962 | Klepper | 74/530 X |
| 3,115,614 | 12/1963 | Habereder | 74/425 |
| 3,264,019 | 8/1966 | Houvener et al. | 292/142 |
| 3,490,307 | 1/1970 | Jetter | 74/425 |
| 4,220,364 | 9/1980 | Poe | 292/341.18 |
| 4,238,969 | 12/1980 | Krause | 74/425 X |
| 4,320,912 | 3/1982 | Grace et al. | 292/341.18 |
| 4,478,446 | 10/1984 | Duran | 292/341.18 |
| 4,509,382 | 4/1985 | Colautti et al. | 74/89.15 |
| 4,682,800 | 7/1987 | Lovelace, Jr. | 292/247 |
| 4,707,007 | 11/1987 | Inoh | 292/341.18 X |

FOREIGN PATENT DOCUMENTS

| | | | |
|---|---|---|---|
| 195503 | 12/1919 | Canada | 292/142 |
| 461014 | 1/1951 | Italy | 292/341.18 |

OTHER PUBLICATIONS

Boeing Service Bulletin 767-71-0037, dated Sep. 5, 1986, revised Sep. 10, 1987, pp. 1 and 2.

*Primary Examiner*—Gary L. Smith
*Assistant Examiner*—Eric K. Nicholson

[57] ABSTRACT

An adjustable keeper mechanism is provided having an adjusting assembly which permits the keeper mechanism to be mounted over a greater range of depths than conventional star-wheel adjusting mechanisms. The adjusting assembly includes a driver 14 and a drive unit (15) which translates rotational movement of the driver (14) into linear movement of a connecting element (10), allowing infinitely small, non-incremental adjustment of the position of the connecting element (10) relative to the structures joined by the mechanism.

12 Claims, 2 Drawing Sheets

10
11
12
13
14
15
16
17
17'
18a
18b
18c
19
20
21
23
30
31
32
33
34
35
40
41
42
50
52
55
56
57
58
59
60
70

VERTICAL ACCESS ADJUSTABLE LATCHING MECHANISM EXTERNALLY ACCESSIBLE ADJUSTABLE KEEPER MECHANISM

TECHNICAL FIELD

The present invention relates to mechanisms which permit adjustment of the position of the mechanism relative to the structures joined by the mechanism. In particular the present invention is directed to keeper mechanisms.

BACKGROUND

The prior art in latch technology teaches various ways by which a latch mechanism may be adjusted for optimum performance in its intended use. In almost all cases the adjustment feature is designed specifically for the particular latch mechanism and thus is useful only in that particular application.

The present invention is directed for use in a variety of latch mechanisms, most notably in the hook latch and keeper type mechanisms. Its adaptability to more than a single application may be attributed to its structural components which are uniquely arranged to provide optimum performance in all aspects of the latching function, i.e., mounting parameters, manual adjustment, load application, repair and replacement of components, etc. The uniqueness and advantages provided by the invention which are not available from the prior art will be described and explained in detail in the description which follows.

SUMMARY OF THE INVENTION

The present invention is an adjustable keeper mechanism which is used to secure structures together, e.g. two parts of an aircraft, and allow an adjustment in the connection therebetween. The invention includes a connecting element and an adjusting assembly to accomplish this goal. The connecting element may be of conventional design. The adjusting assembly however is unique and includes a driver and drive unit. The driver is tool operable from the exterior surface of the structures in which the mechanism is mounted. The end of the driver, opposite the tool operable end, has a meshing surface. This meshing surface engages with a meshing surface on the drive unit to effect rotation of the drive unit. A portion of the connecting element is threaded within the drive unit. The drive unit translates its rotational movement into linear movement of the connecting element. The connecting element is restrained from rotational movement by a mechanism which may be separate from the assembly and the connecting element.

A housing is provided which surrounds and contains the interacting meshing surfaces of the driver and drive unit. Surfaces are constructed in the housing whereby the driver may be held in pre-determined alignment with respect to the drive unit.

Further details of the construction of the invention and the advantages gained thereby are disclosed in the description which follows and the accompanying drawings.

DETAILED DESCRIPTION OF A PREFERRED EMBODIMENT

Figures 1, 2:
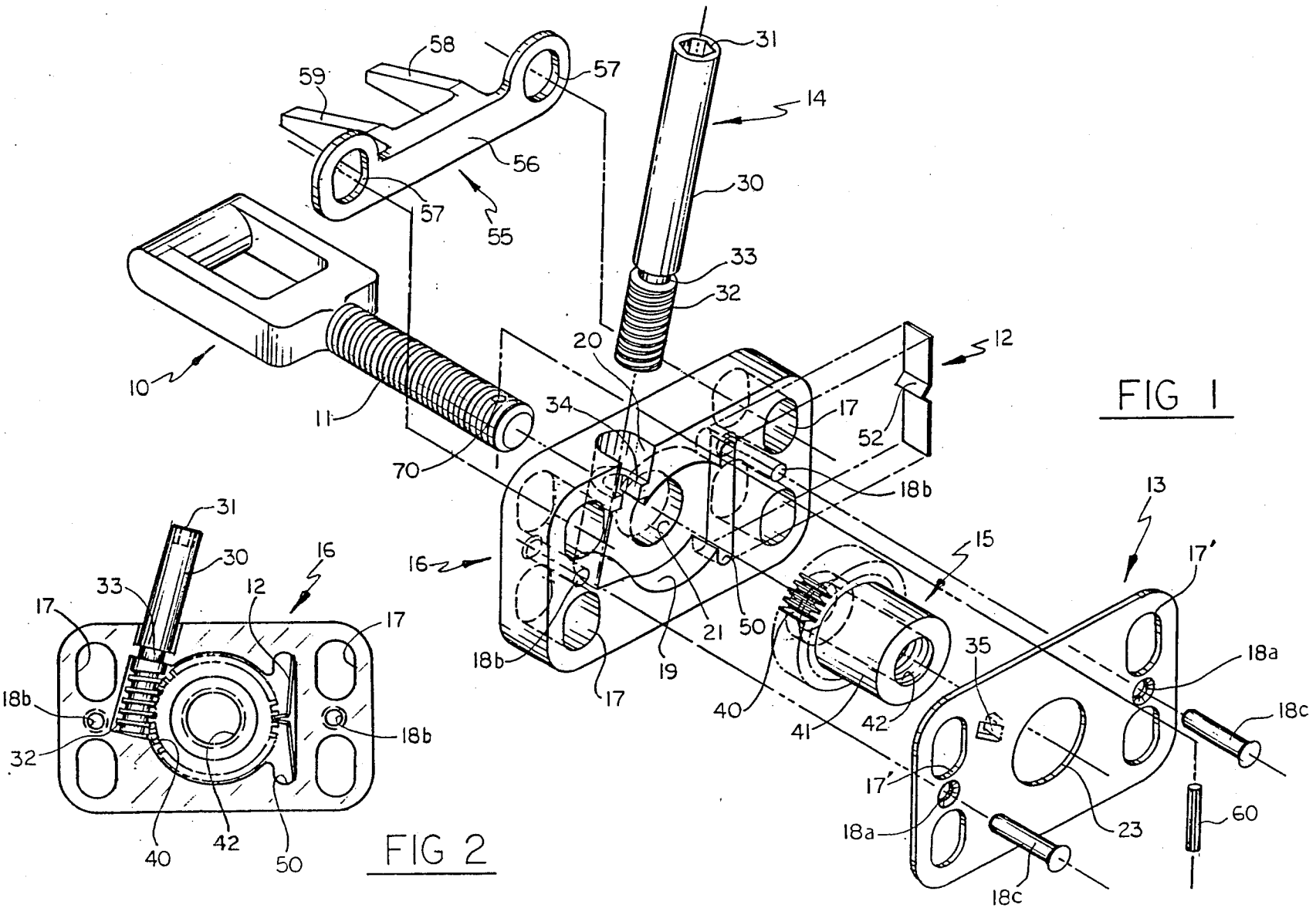
FIG. 1 is an exploded view in perspective of a preferred embodiment of the present invention.
FIG. 2 is a plan view in elevation showing a portion of the preferred embodiment during assembly thereof.
Figure 3:
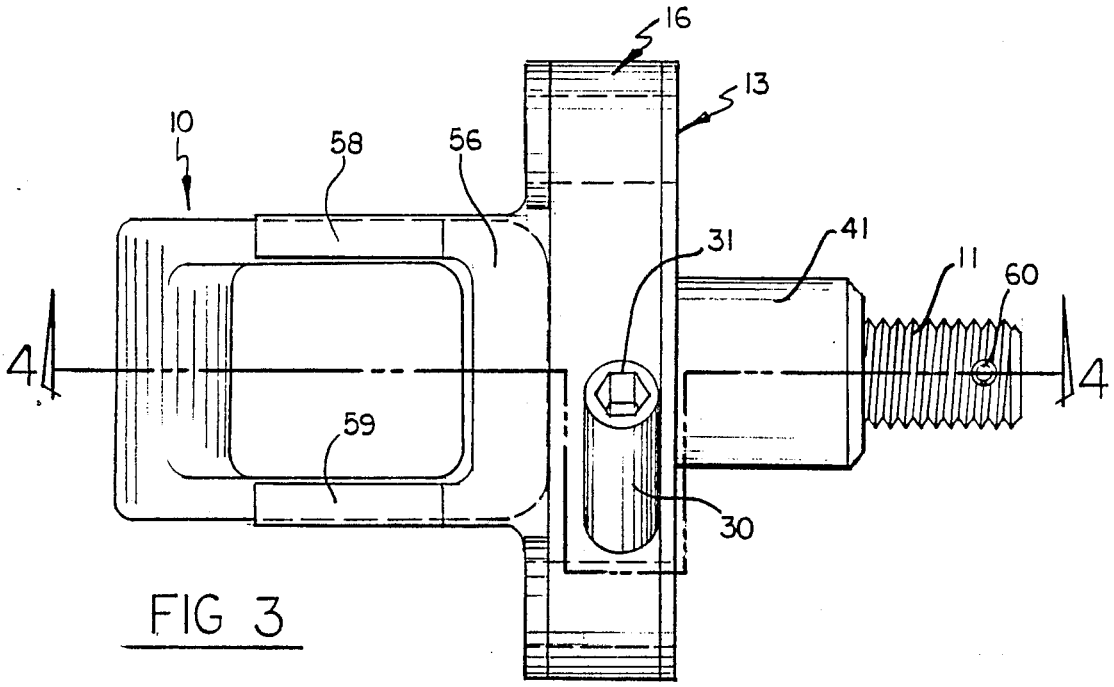
FIG. 3 is a top plan view of the preferred embodiment in assembled form.

In the drawings like reference numerals are used throughout the several views to indicate identical or like elements.

FIG. 1 illustrates in detail a preferred embodiment of the adjustable keeper mechanism of the present invention. It should be noted that while a keeper-type mechanism is shown the invention is not limited solely to use in such applications. The invention may be adapted for use in the hook portion of a latch mechanism, as well as other types of mechanisms requiring the type of adjustment possible with the present invention.

The components of the invention are a connecting element, e.g. a keeper, and an assembly for adjusting the position of the connecting element relative to the two structures which are being joined by the latch mechanism. The connecting element 10 may be, and is shown in the drawings as, a conventional type well known in the art. The connecting element has an externally threaded portion 11 for purposes to be explained hereinafter. The adjusting assembly includes a driver 14 and a drive unit 15 which translates rotational movement in linear movement of the connecting element 10.

The preferred embodiment includes a housing constructed for mounting to one of the structures which is to be secure by the latch mechanism. A first and major portion 16 of the housing is typically rectangular in shape and includes any selected number of openings 17 for permitting screws, bolts or other type of fastener (not shown) to be inserted therethrough for mounting the housing to a prepared surface on one of the structures (not shown). The rearward facing side of this portion 16 includes a recessed area 19, in this case substantially circular in shape. Adjacent the recessed area 19, near its uppermost end, is an access opening 20. The access opening 20 accommodates a portion of the driver 14 to be explained hereinafter. The recessed area 19 also includes a centrally located through hole 21.

A second portion of the housing in the preferred embodiment is a cover 13. It is provided for closing the recessed side of the other housing portion 16. The cover 13 includes openings 17' situated for alignment with the openings 17 in the first portion 16 of the housing. The cover 13 also includes a centrally located opening 23 therein. This opening 23 serves as a guide for a portion of the drive unit 15 to be explained hereinafter. The cover 13 includes apertures **18*a* which align with mating openings 18*b* in the major portion 16 into which fasteners 18*c* are installed for fixing the cover 13 securely to the major portion 16** of the housing.

The housing 16, 13 is constructed as explained above to surround and contain portions of the adjusting assembly. The adjusting assembly of the preferred embodiment includes three elements, i.e. a driver 14, a drive unit 15, and spring means 12 for restraining the drive unit and driver against inadvertent rotational movement. The adjusting assembly is unique in that it departs from the known tool-operated star-wheel constructions. Specifically, a driver 14 is provided which interacts with a drive unit for effecting adjustment of the latching mechanism. The driver 14 includes a shaft portion 30 having at its free end 31 any conventional tool-engageable recess. At the opposite end of the shaft is a meshing surface 32, e.g. threaded or tooth gear construction. Between the meshing surface 32 and the remaining relatively smooth shaft surface is a recessed surface area or groove 33.

The housing 16 has a free-standing support surface or rib 34 which is located between the access opening 20 and the housng recessed area 19. In the preferred embodiment illustrated in FIG. 1 it can be appreciated that the rib 34 is u-shaped in order to accommodate the driver shaft 30 by surrounding the shaft at the recessed surface area 33. The shaft 30 rests upon the adjacent surface of the rib 34 with the driver meshing surface 32 extending into the housing recess area 19. See FIG. 2. In this manner the driver 14 is aligned in at least one direction relative to the drive unit 15. A second support surface 35 may also be provided to insure alignment of the driver 14 in a direction non-parallel to the rib 34 upon which the shaft rests. In the preferred embodiment this second support surface 35 is formed as a tab from a portion of the cover 13 directly adjacent the drive recessed surface area 33. The tab 35 extends within the recessed surface area 33 when the mechanism is assembled.

Figure 4:
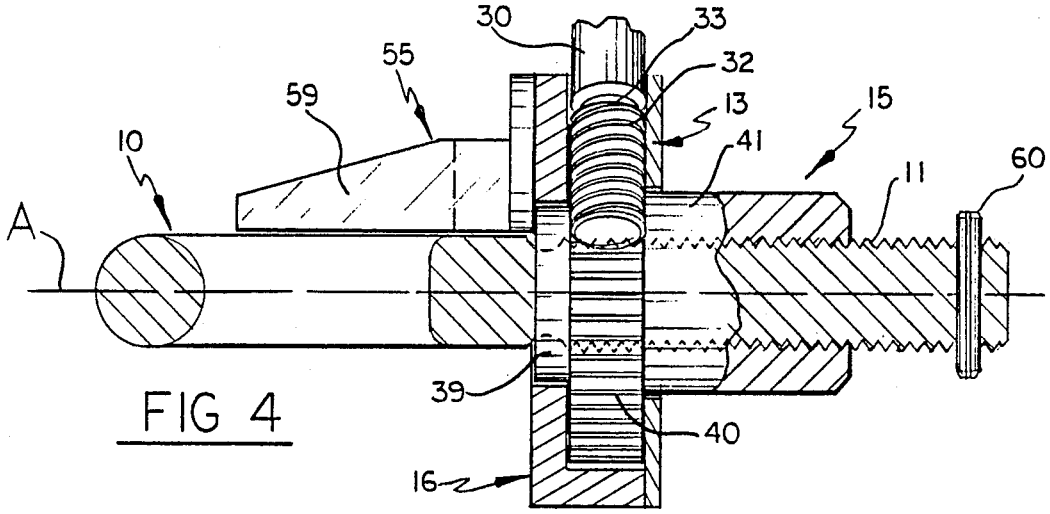
FIG. 4 is a view in cross-section of the preferred embodiment as seen generally along lines 4—4 in FIG. 3.
Figure 5:
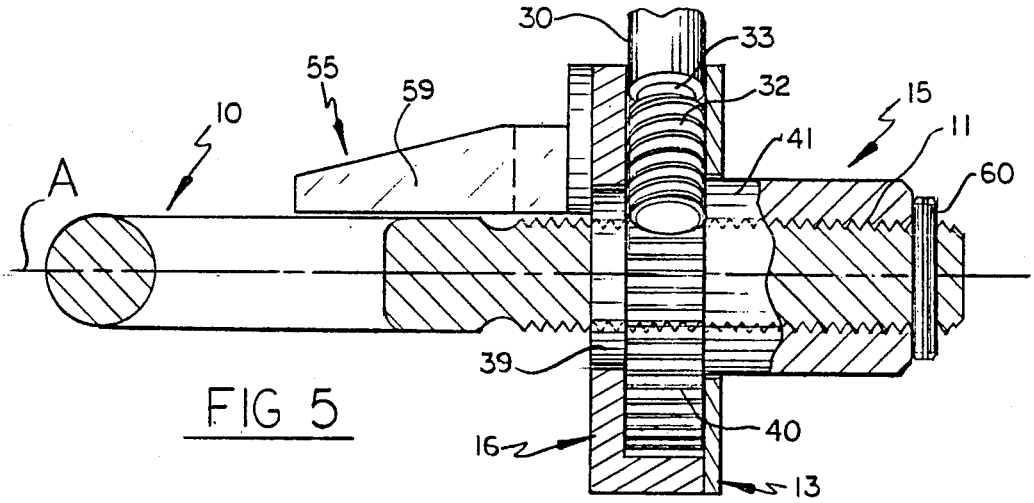
FIG. 5 is a view in cross-section of the preferred embodiment as it would appear when adjusted to its fully extended position.

The second part of the adjusting assembly is the drive unit 15. In the preferred embodiment the drive unit 15 has portions which are substantially circular shaped. On the forward facing side of the drive unit 15 is a boss 39 (FIGS. 4 and 5). The boss 39 is of a shape and size which permit its insertion into and containment by the housing through-hole 21. This may provide alignment for the drive unit within the housing. Rearward of the boss and along a periphery of the drive unit is a continuous row of gear teeth 40. The gear teeth 40 form a second meshing surface which is constructed to interact with and engage the meshing surface or threads 32 on the driver 14. Rearward of the gear teeth 40 is the portion of the drive unit 15 which provides the mechanism by which rotational movement of the drive unit 15 may be translated into linear movement, i.e. adjustment, of the connecting element. This portion has a relatively smooth outer wall 41 and a threaded internal wall or through-hole 42 extending the full length of the drive unit. The diameter of the threaded through-hole 42 and of the housing opening 21 are each of a size to permit the threaded portion 11 of the connecting element 10 to pass through the housing opening 21 and be threadably engaged and contained by the drive unit through-hole 42. The outer diameter of the second meshing surface or gear teeth 40 cannot be greater than the diameter of the recessed area 19 in the housing 16 in order to permit rotation of the drive unit when it is assembled in the housing.

In order that the driver 14 and the drive unit 15 be restrained from inadvertent rotation after the proper adjustment of the keeper mechanism has been accomplished, a spring means 12 has been provided in the preferred embodiment. A second recess 50 is formed in the housing 16 immediately adjacent and continuous with the recessed opening 19. A suitable leaf spring 12 having an interrupted surface area or v-shaped portion 52 is formed to interfere with the movement of the drive unit and be positioned between any two adjacent gear teeth 40 on the drive unit meshing surface. The force of the spring is selected to prevent inadvertent rotation of the drive unit and the driver, but it must also permit rotation of the drive unit by an operator when adjustment is desired.

A final component of the preferred embodiment is a means by which rotational movement of the connecting element 10 is prevented. In the preferred embodiment this mechanism is constructed separately from the adjusting assembly and the connecting element. As shown in FIG. 1 a rigid shelf 55 may be secured to the housing 16 at a location above the connecting element 10 by the same fasteners which mount the housing to one of the structure being latched by the latching mechanism. The rigid shelf 55 includes a rearward portion 56 which contains a pair of openings 57 arranged so as to be in alignment with the upper openings 17, 17' in the housing 16, 13, respectfully. Extending forward of this portion 56 are a pair of fingers or arms 58, 59 which are formed so as to lie directly above the non-threaded portion of the connecting element. The connecting element is prevented from rotation by the rigid arms 58, 59 which are fixed and thereby obstruct rotational movement of the connecting element itself. Of course, it should be understood that this component of the invention may be constructed as an integral part of the housing 16, i.e. as part of a cast or molded housing.

To assemble the preferred embodiment the following steps are taken: The drive unit 15 is first positioned in the major portion 12 of the housing so that the boss 39 is held by the housing opening 21 and its gear teeth 40 are contained within the recess 19. The driver 14 is then positioned in the housing excess 20 so that its threads 32 interact and engage the gear teeth 40 and the shaft portion immediately above the groove 33 is resting on the rib 34. The spring 12 is installed in the recess 50 so that its interrupted surface 52 is positioned between a pair of teeth of the drive unit gear surface 40. The cover plate 13 is then secured to the back of the housing portion 16 by fasteners 18C, with the rearward portion of the drive unit 15 extending through the opening 23 and beyond the cover plate 13. The connecting element portion 11 is then threaded into the adjusting assembly into mating engagement with the inner threads of the drive unit 15. When the connecting element threaded portion 11 extends beyond the cover 13, a pin 60 may be inserted through a hole 70 in the protruding end of the connecting element to prevent the connecting element from being removed form the assembled latch mechanism. The preferred embodiment is then ready for mounting and use.

The operation of the invention may be appreciated from a study of FIGS. 4 and 5. In FIG. 4 the connecting element 10, is shown in a retracted condition. All linear movement of the connecting element along its axis A is a direct result of rotational movement of the drive unit 15. Movement of the drive unit 15 is directed by rotational movement of the driver 14, and the driver may only be operated by a tool being inserted into its free end 31. Rotational movement of the driver 14 causes rotational movement of the drive unit 15 as a result of the interacting engagement of the driver threads 32 and the drive unit gear teeth 40. Because the connecting element 10 is restricted from rotating relative to the housing 12 by the shelf 55, the rotational movement of the drive unit 15 is translated into linear movement of the connecting element as the drive unit 15 rotates with the driver 14 and around the connecting element 10. Thus as can be seen in a comparison of FIGS. 4 and 5, as the rotatable element is rotated, in one direction, the drive unit 15 advances forward to the extent permitted by the pin 60 in the connecting element. Depending on the direction the driver 14 is rotated and upon the fineness of the thread and gear teeth selected for the various parts of the preferred embodiment, the connecting element may be adjusted in infinitely small, non incremental amounts forward and rearwardly.

The primary advantage of the invention may now be appreciated. The driver of the present invention permits the user to mount the keeper mechanism at a wider range of depths relative to the exterior of the structures joined by the latching mechanism, i.e. engine cowl. This is not possible with the conventional star-wheel constructions where the adjusting assembly must be mounted close to the access opening in the structure in order to permit the insertion of a tool into the structures in order to effect the adjustment of such star-wheel mechanisms. That is, if a conventional start-wheel type latching mechanism is mounted too deep or too far below the access opening in the structure surface, its adjustment will not be possible any tool will be limited in its movement with respect to the access opening and accordingly the start-wheel cannot be rotated. In the present invention this problem will not occur as the driver shaft 30 may be desigend to whatever length necessary without loss of any adjustment capability. Driver recess 31 will remain at the access opening and functional regardless of the length of the driver.

In view of the foregoing it should be clear that the invention affords advantages and a degree of flexibility in design which is not provided by any known prior art device. Other embodiments for the invention from that shown in the drawings may be possible to persons skilled in this art field. Accordingly, the scope of the protection for this invention is believed limited only by the claims which follow.

What is claimed is:

1. An adjustable keeper mechanism constructed and arranged for securing a first structure relative to a second structure, said mechanism comprising:

a connecting element having a longitudinal axis for joining a first structure to a second structure;

an assembly for adjusting the position of said connecting element along its longitudinal axis relative to the structures:

said assembly including a driver and a rotatable drive unit;

said driver having a tool operable, free, first end at the exterior surface of one of said structures and a second end opposite thereto, said driver second end having a first meshing surface thereon;

said drive unit having a second meshing surface arranged for interacting engagement with said first meshing surface for translating rotational movement to said drive unit upon rotation of said driver;

said drive unit receiving said connecting element for translating rotational movement of said drive unit into linear movement of said connecting element along its longitudinal axis; and said driver having a length predetermined by the depth at which said assembly is mounted from the exterior surface of said structures, permitting the mounting of said adjustable keeper mechanism and its said assembly over a range of depths within said first and second structures.

2. The adjustable keeper mechanism of claim 1 wherein:

said first intermeshing surface is a worm thread and said second intermeshing surface has worm gear teeth which mate with said worm thread for effecting rotation of said drive unit by said driver;

said connecting element is threaded along a portion of said longitudinal axis; and said drive unit is threaded to receive said threaded portion of said connecting element.

3. The adjustable keeper mechanism of claim 1 further comprising:

a housing surrounding a portion of said drive unit and containing said driver second end therein, said housing including means for aligning said driver relative to said drive unit;

said driver having a recessed surface area intermediate said driver first and second ends;

said aligning means in said housing includes a first supporting surface constructed to receive said driver recessed surface area; and said aligning means further includes a second supporting surface arranged non-parallel to said first supporting surface, said second supporting surface being received in said driver recessed area for restraining movement of said driver relative thereto.

4. The adjustable keeper mechanism of claim 3 further comprising:

said housing having a slot therein;

spring means in said housing slot for restraining movement of said drive unit and said driver.

5. The adjustable keeper mechanism of claim 1, additionally comprising:

means for preventing rotational movement of said connecting element as said element is adjusted along its longitudinal axis during rotation of said drive unit.

6. The adjustable keeper mechanism of claim 1, wherein:

said driver is an extended shaft which is free of loading associated with securing said first and second structures.

7. An adjustable keeper mechanism constructed and arranged for securing a first structure relative to a second structure, said mechanism comprising:

a connecting element having a longitudinal axis for joining a first structure to a second structure;

an assembly for adjusting the position of said connecting element along its longitudinal axis relative to the structures:

said assembly including a driver and a rotatable drive unit;

said driver having a tool operable, free, first end at the exterior surface of one of said structures and a second end opposite thereto, said driver second end having a threaded meshing surface thereon;

said drive unit receiving said connecting element and having a second meshing surface and means for translating rotational movement thereof into linear movement of said connecting element, along its longitudinal axis, said second meshing surface having gear teeth arranged for interacting engagement with said driver threaded meshing surface;

means for preventing rotatational movement of said connecting element as said connecting element is longitudinally adjusted by rotation of said drive unit; and said driver having a length predetermined by the depth at which said assembly is mounted from the exterior surface of said structures, permitting the mounting of said adjustable keeper mechanism and its said assembly over a range of depths within said first and second structures.

8. The adjustable keeper mechanism of claim 7 further comprising:

a housing surrounding a portion of said drive unit and containing said driver second end therein, said housing including means for aligning said driver relative to said drive unit;

said driver having a recessed surface area intermediate said driver first and second ends;

said aligning means in said housing includes a first supporting surface constructed to receive said driver recessed surface area; and said aligning means further includes a second supporting surface arranged non-parallel to said first supporting surface, said second supporting surface being received in said driver recessed area for restricting movement of said driver relative thereto.

9. The adjustable keeper mechanism of claim 7 further comprising:

said housing having a slot therein;

spring means in said housing slot for restraining movement of said drive unit and said driver.

10. An adjustable keeper mechanism for joining a first structure to a second structure, comprising:

a keeper having a threaded portion extending longitudinally therefrom;

a drive unit for threadably receiving said threaded portion of said keeper, said drive unit having an outer periphery provided with gear teeth therein;

a driver having a tool operable, free, first end at the exterior surface of one of said structures and gear threads formed in a second end thereof for engaging said gear teeth within said drive unit;

a housing for mounting said driver and drive unit such that rotation of said driver rotates said drive unit for imparting a linear motion to said keeper; and said driver including a shaft whose length is predetermined by the depth at which said housing is mounted from the exterior surface of the structures, permitting the mounting of said adjustable keeper mechanism and its said housing over a range of depths within said first and second structures.

11. The adjustable keeper of claim 10, wherein:

said driver is a shaft mounted within said housing to the side of said drive unit outer periphery to be free of loading created by said joining of said first and second structures.

12. An adjustable keeper mechanism for joining a first structure to a second structure, comprising:

a keeper having a threaded portion extending longitudinally therefrom;

a drive unit for threadably receiving said threaded portion of said keeper, said drive unit having an outer periphery provided with gear teeth thereon;

a driver having a tool operable, free, first end at the exterior surface of one of said structures and gear threads formed in a second end thereof for engaging said gear teeth within said drive unit;

a housing for mounting said driver and drive unit such that rotation of said driver rotates said drive unit for imparting a linear motion to said keeper;

said housing further mounting said driver free of loading associated with joining said first and second structures; and said driver including a shaft whose length is predetermined by the depth at which said housing is mounted from the exterior surface of the structures, permitting the mounting of said adjustable keeper mechanism and its said housing over a range of depths within said first and second structures.

* * * * *